United States Patent [19]

Roy

[11] 4,347,774

[45] Sep. 7, 1982

[54] ACTUATOR FOR CAPTURE TYPE COMBINATION SYSTEM IN ORGANS

[76] Inventor: Irene Roy, 1080 Bordeleau, Ste-Hyacinthe, Quebec, Canada

[21] Appl. No.: 277,336

[22] Filed: Jun. 25, 1981

[51] Int. Cl.[3] ..... G10B 3/10

[52] U.S. Cl. ..... 84/345

[58] Field of Search ..... 84/344, 345

[56] References Cited

U.S. PATENT DOCUMENTS 1,664,053 3/1928 Verlinden ..... 84/345

*Primary Examiner*—L. T. Hix

*Assistant Examiner*—Thomas H. Tarcza

[57] ABSTRACT

There is disclosed an actuator for the selector hooks of the capture type combination system used in mechanical or electro-pneumatic organs. All the selector hooks which have been shifted to operating position are simultaneously pulled down by a mechanism actuated by a crank system driven by an electric motor.

9 Claims, 3 Drawing Figures

ACTUATOR FOR CAPTURE TYPE COMBINATION SYSTEM IN ORGANS

FIELD OF INVENTION

The present invention relates to the means for moving the selector hooks of a capture type combination system in mechanical or electro-pneumatic organs.

Such a combination system enables the organ player to automatically render operational or non-operational, pre-selected combinations of organ voices.

BACKGROUND OF THE INVENTION

The conventional way of actuating the selector hooks is to use a solenoid operated plunger. With organs having a great number of voices, the solenoid operated plunger must often exert a great force to bring down the chosen selector hook, because of the number of voices activated; it is therefore expensive and, moreover, operation of such plunger produces a thumping noise which is much disliked by organ players.

OBJECTS OF THE INVENTION

It is therefore the general object of the invention to provide an actuator mechanism for the selector hooks of capture type combination systems in organs, which is of a smooth and quiet operation, which is relatively non-expensive and which can operate a selector hook, even if the latter has to activate a large number of organ voices.

SUMMARY OF THE INVENTION

In accordance with the invention, a board is pivoted adjacent to the row of selector hooks of a capture type combination system and is driven through one cycle of reciprocating movement by a crank mechanism driven by an electric motor through one turn. Switching means stops operation of the electric motor after one turn of the crank mechanism.

Preferably safety means are provided to prevent breakage of parts of the system in case one or more of the selector hooks are jammed.

BRIEF DESCRIPTION OF THE DRAWINGS

In the annexed drawings which illustrate the preferred embodiment of the invention.

In the annexed drawings like referrenced characters indicates like elements throughout.

DETAILED DESCRIPTION OF INVENTION

Figures 1, 2, 3:
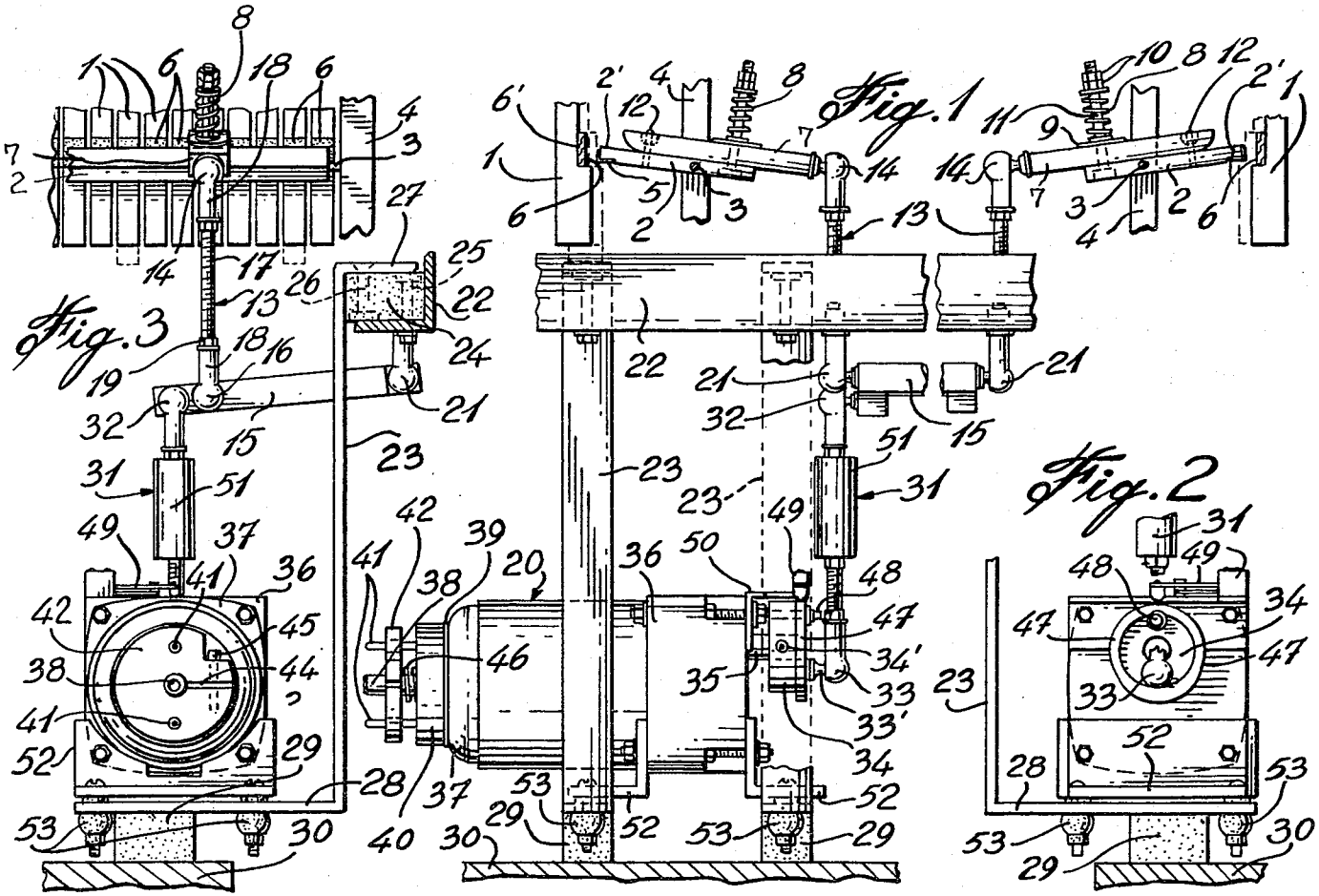
FIG. 1 is a side view of the actuator mechanism.
FIG. 2 is a partial right-hand elevation.
FIG. 3 is a left-hand elevation.

Reference numeral 1 indicates the lower portion of vertically arranged selector hooks of conventional construction and which are part of a capture type combination system for organs (not shown). The selector hooks 1 are arranged normally in two rows, one at each side of the organ console. The selector hooks are arranged for individual lateral/shiftable movement as shown in full and in dashed lines in FIG. 1 by means not shown and which are conventional in such combination systems. The selectors are also arranged for downward movement producing the desired change of state in the stops of the organ pipes. The actuator of the invention is designed to pull down the one selector hook 1 of one or of the two rows, which has been laterally shifted to the dotted line operating position shown in FIG. 1 while the remaining selector hooks remain in their initial inoperating position. Once the selector hook has been pulled down, it returns to its upper position under the action of individual springs (not shown).

The actuator of the present invention comprises a first lever board 2, both ends of which are pivoted at 3 to frame uprights 4. The front edge 2' of lever board 2 is lined with felt or the like 5, and is adapted to engage and push down on the upwardly facing step 6 of the selector hook 1 of the row of such hooks which has previously been laterally shifted to the dotted line operating position shown in FIG. 1. Each lever hook 1 has a lining 61 of felt on the like adjacent step 6.

The lever board 2 extends over the entire length of the row of selector hooks 1. A top lever 7 overlies lever board 2 and extends rearwardly from same. The second lever 7 is elastically pressed against the lever board 2 by means of a compression coiled spring 8 exerting a force on top of board 7 against washer 9 and adjustably retained at its upper end against a washer and nuts 10 screwed on a bolt 11 extending through the spring 8 and carried by the rear portion of lever board 2. A guiding pin 12 is carried by the lever board 2 at the front portion thereof and extend through a guide hole made in the top lever 7. The rear edge of the top lever 7 is attached to a connecting rod 13 by means of a ball joint 14. The lower end of the connecting rod 13 is pivotally connected to the side of an intermediate lever board 15 by means of a ball joint 16. The connecting rod 13 is adjustable in length, being composed of a threaded rod 17 adjustably screwed in the sockets 18 of the two ball joints 13 and 16 and locked in place by lock nuts 19. The intermediate lever board 15 extends at right angles to the lever board; 2 across the back of the organ console so that the two connecting rods 13 can be attached to the lever board 15 at both ends of same.

As shown in FIG. 1, there are two lever board assemblies 2 and 7, each associated with a row of selector hooks 1 and both lever board assemblies are adapted to be actuated simultaneously by a single electric motor indicated at 20.

Each end of the intermediate lever board 15 is fitted with ball joint connections 21 secured to an angle iron 22 extending across the back of the organ console and forming part of the console frame. This angle iron 22 supports at least two L-shaped motor support bars 23 through the intermediary of a rubber block 24. The angle iron 22 is secured to the rubber block 24 by means of bolts and nuts 25 and block 24 is secured under the bent upper end 27 of the flat bar 23 by bolts and nuts 26. The lower horizontal leg 28 of the support bar 23 rests on a rubber block 29 in turn resting on a bottom 30 of the console frame.

A crank rod assembly 31 is attached at its upper end by means of a ball joint 32 to a front corner of the intermediate lever board 15 adjacent to the ball joint 14 of one connecting rod 13. The lower end of the crank rod assembly 31 is connected by a ball joint 33, to a crank disc 34 secured by set screw 34 to the output shaft 35 of a speed reducer unit 36 attached to the motor housing 37 and the input shaft of which is driven by the output shaft of the electric motor 20. This motor shaft is shown at 38 and extends from the back of the motor housing. At this location there is provided a braking system to prevent over-run in the rotation of the crank disc 34. For this purpose a felt lining 39 is adhered to the back of the motor housing around the motor shaft 38. A brake disc 40 is slidable on the motor shaft 38 and carries pins 41 which are slidable in a driving disc 42 secured to motor shaft 38. The driving disc 42 is split as shown at 44 and is retained on the motor shaft 38 by means of a set screw 45. A compression coil spring 46 extends between the driving disc 42 and the brake disc 40. The longitudinal position of the driving disc 42 can be adjusted on shaft 38 so as to adjust the braking effect of the braking disc 40 applied against the felt lining 39.

An annular cam 47 is mounted on the reduced outer end of crank disc 34. This cam can be rotationally adjusted by a set screw 48.

An electric switch blade assembly 49 is mounted on a bracket 50 secured to the housing of the speed reducer 36. The switch blade assembly 49 rides on cam 47 to be actuated by same.

Preferably, the crank rod assembly 31 is longitudinally adjustable as are the connecting rods 13 and further comprises a shock absorber 51.

The entire assembly of the motor and its speed reducer are supported by brackets 52 secured to the lower horizontal legs 28 of the two support bars 23 by means of nuts and bolts and rubber bushings 53.

A conventional electric circuit (not shown) and including the switch assembly 49 controls the operation of the motor 20 such that once started, the motor will continue rotating the crank pin 33 attached to crank 34 for a full turn at which time the cam 47 will open the switch 49 and stop operation of the electric motor.

The braking system prevents over-run of the crank disc 34. The switching assembly is designed such that the motor will start again at the next electric impulse given by the organ player.

The actuator operates as follows. Once the selected one of the selector hooks, on one or on both sides of the organ console, has been laterally shifted to its dotted line operating position shown in FIG. 1, and the organ player starts motor 20, the latter will turn crank disc 34 one full turn from its position shown in FIGS. 1 and 2 in which the crank pin 33 is in its lowermost position and in which, consequently, the front edge 21 of lever board 2 is at its uppermost position engaging with the step of the operative selector hook 1. During rotation of the crank disc, the intermediate lever board 15 will first rise and then move downwardly to cause both lever boards to move first downwardly and then upwardly. During the downward movement of the lever boards 2 the selector hook 1 engaged by the same will be pulled downwardly and therefore change the condition of the stops of the organ pipes associated therewith. During the upward movement of the lever boards 2 the selector hooks 1 simply move up under the action of its own spring (not shown).

Should a selector hook become jammed, thus preventing downward movement pivoting movement of the lever boards 2, the rear end of the top lever 7 will simply move up against the action of the coil spring 8 thereby avoiding any break in the combination systems.

All the mechanism is rubber-mounted and suitable felt linings serve as cushioning material. The shock absorber 51 absorbs any shocks which could occur in the mechanism. Motor vibration is not transmitted to the rest of the organ framework due to the rubber mounting of the motor and associated mechanism.

What I claim is:

1. An actuator for the selector hooks of a capture type combination system in an organ, said selector hooks arranged in at least one row and selectively shiftable laterally of said row between an operation and an inoperating position, a lever board pivotally mounted on a support frame and having a front edge extending parallel with said row and engageable with the selector hook shifted to operating position and clearing those selector hooks remaining in inoperating position, an electric motor, crank means driven by said motor and connected to said lever board to cause reciprocating movement of said lever board with said front edge engaging and longitudinally moving said shifted selector hooks and motor operated switch means to stop said motor after one complete rotation of said crank means.

2. An actuator as defined in claim 1, further including a speed reducer driven by said motor and having an output shaft, said crank means including a crank pin attached to said output shaft and a crank rod pivotally connected to said crank pin.

3. An actuator as defined in claim 2, further including a rotationally adjustable cam carried by said output shaft and engageable with said switch means to operate same.

4. An actuator as defined in claim 3, further including a brake means driven by the shaft of said motor and applying a continuous braking force on said motor shaft to prevent over-run of the rotation of said output shaft.

5. An actuator as defined in claim 2 wherein said crank rod is longitudinally adjustable and is made of two sections interconnected by a shock absorber.

6. An actuator as defined in claim 2, wherein said lever board is made of two spring biased overlapping parts, one part defining said front edge and the other part being connected to said crank means whereby jamming of any selector hook against its longitudinal movement will cause separation of said two parts during rotation of said crank means.

7. An actuator as defined in claim 1, wherein there are two spaced rows of selector hooks with the rows being spaced and parallel to each other and wherein there is one lever board associated with each row, said crank means including an intermediate lower board pivoted on a support frame and extending substantially perpendicular to said first-named lever boards, said connecting rod being pivotally attached to said intermediate lever board and additional connecting rods pivotally interconnecting said two first-named lever boards and said intermediate lever board.

8. An actuator as defined in claim 7, wherein each of said additional connecting rods is longitudinally adjustable.

9. An actuator as defined in claim 2, wherein the assembly of said motor and of its speed reducer is mounted on vibration-absorbing pads.

* * * * *